US007416477B2

(12) United States Patent
Henke et al.

(10) Patent No.: US 7,416,477 B2
(45) Date of Patent: Aug. 26, 2008

(54) SANDER TOOL WITH PIVOTING HANDLE AND ATTACHABLE POL

(75) Inventors: David R. Henke, Maple Grove, MN (US); Thomas Grimm, Robbinsdale, MN (US)

(73) Assignee: Warner Manufacturing Company, Minneapolis, MN (US)

( * ) Notice: Subject to any disclaimer, the term of this patent is extended or adjusted under 35 U.S.C. 154(b) by 165 days.

(21) Appl. No.: 11/372,622

(22) Filed: Mar. 10, 2006

(65) Prior Publication Data

US 2007/0212989 A1 Sep. 13, 2007

(51) Int. Cl.
*B24B 23/00* (2006.01)

(52) U.S. Cl. ..... 451/344; 451/354; 451/524

(58) Field of Classification Search ..... 451/344, 451/354, 350, 523, 524
See application file for complete search history.

(56) References Cited

U.S. PATENT DOCUMENTS

| | | | | |
|---|---|---|---|---|
| 1,544,368 | A | | 6/1925 | Brennan |
| 1,966,633 | A | | 7/1934 | Lee |
| 2,201,645 | A | | 5/1940 | Epner |
| 2,334,039 | A | | 11/1943 | Rueb |
| 2,437,827 | A | | 3/1948 | Lund |
| 2,454,668 | A | | 11/1948 | Nissenbaum |
| 2,663,979 | A | | 12/1953 | Sierchio |
| 2,711,059 | A | | 6/1955 | Ames |
| 2,954,649 | A | | 10/1960 | Carroll et al. |
| 3,123,946 | A | | 3/1964 | Hoveland |
| 3,224,149 | A | | 12/1965 | Harrington et al. |
| 3,231,917 | A | * | 2/1966 | Reed ..... 15/98 |
| 3,362,037 | A | | 1/1968 | Griffin |
| 3,483,662 | A | | 12/1969 | Ames |
| 3,498,009 | A | | 3/1970 | Taafe |
| 3,850,533 | A | | 11/1974 | Thielen |
| 3,991,431 | A | | 11/1976 | Thielen |
| 4,221,084 | A | | 9/1980 | Frantzen |
| 4,225,998 | A | | 10/1980 | Thielen |
| 4,475,262 | A | | 10/1984 | Downer |
| 4,516,360 | A | | 5/1985 | Gringer et al. |
| 4,516,361 | A | | 5/1985 | Gringer |
| 4,658,461 | A | | 4/1987 | Roe et al. |
| 4,885,876 | A | * | 12/1989 | Henke ..... 451/503 |
| 4,937,984 | A | * | 7/1990 | Taranto ..... 451/524 |
| D310,012 | S | | 8/1990 | Henke et al. |
| 5,103,599 | A | | 4/1992 | Carlson |
| 5,168,672 | A | | 12/1992 | Gregoire, Sr. |
| 5,293,662 | A | | 3/1994 | Newman, Sr. et al. |
| D346,944 | S | | 5/1994 | Poole |
| 5,319,888 | A | * | 6/1994 | Huber et al. ..... 451/357 |
| D349,635 | S | | 8/1994 | Berti et al. |
| 5,338,128 | A | | 8/1994 | Blanco |

(Continued)

OTHER PUBLICATIONS

U.S. Design Appl. No. 29/255,203, filed Mar. 6, 2006.

(Continued)

*Primary Examiner*—Eileen P. Morgan
(74) *Attorney, Agent, or Firm*—Hamre, Schumann, Mueller & Larson, P.C.

(57) ABSTRACT

Disclosed is a sander tool suited for sanding planar surfaces, and mechanisms enabling the pivoting of an ergonomic handle. Also disclosed is a sander tool having a detachable pole for use in reaching areas located outside the user's normal reach.

15 Claims, 7 Drawing Sheets

U.S. PATENT DOCUMENTS

| | | | | |
|---|---|---|---|---|
| 5,428,865 | A * | 7/1995 | Yarbrough | 15/353 |
| 5,474,490 | A | 12/1995 | Allport | |
| D369,080 | S | 4/1996 | Tollis | |
| 5,512,010 | A | 4/1996 | Labad, Jr. | |
| 5,588,904 | A | 12/1996 | Allport | |
| 5,718,622 | A | 2/1998 | Jones | |
| 5,876,141 | A | 3/1999 | Hsu | |
| 5,902,176 | A | 5/1999 | Chen | |
| 6,095,911 | A * | 8/2000 | Edens | 451/524 |
| 6,227,959 | B1 | 5/2001 | Beaudry | |
| 6,305,043 | B1 * | 10/2001 | Rosnak | 15/144.2 |
| 6,379,237 | B1 | 4/2002 | Gordon | |
| D462,597 | S | 9/2002 | Deshler | |
| 6,524,175 | B2 | 2/2003 | Beaudry et al. | |
| D477,764 | S | 7/2003 | Magann | |
| 6,634,937 | B1 | 10/2003 | Edwards et al. | |
| 6,641,469 | B2 | 11/2003 | Deshler | |
| 6,659,852 | B1 | 12/2003 | Wettstein et al. | |
| 6,722,967 | B1 | 4/2004 | Oddo et al. | |
| 6,889,917 | B2 | 5/2005 | Fahy et al. | |
| 6,935,936 | B2 | 8/2005 | Goulet et al. | |
| 6,942,004 | B2 | 9/2005 | Whittemore | |
| 6,953,076 | B2 | 10/2005 | Whittemore | |
| D512,295 | S | 12/2005 | Florio | |
| 6,988,940 | B1 * | 1/2006 | Taylor | 451/354 |
| 6,991,529 | B2 * | 1/2006 | Annis et al. | 451/557 |
| 7,033,259 | B1 * | 4/2006 | Seasholtz et al. | 451/354 |
| D527,240 | S | 8/2006 | Kirschhoffer et al. | |
| D530,178 | S | 10/2006 | Bortz | |
| 7,144,300 | B1 | 12/2006 | Cybulski et al. | |
| 2005/0287937 | A1 * | 12/2005 | Florio | 451/354 |
| 2006/0205331 | A1 | 9/2006 | Gringer et al. | 451/532 |

OTHER PUBLICATIONS

U.S. Design Appl. No. 29/255,227, filed Mar. 6, 2006.

* cited by examiner

SANDER TOOL WITH PIVOTING HANDLE AND ATTACHABLE POL

FIELD

The invention generally pertains to the field of construction tools, and more particularly to sander tools having a pivoting handle mechanism, to aid in the sanding of surfaces.

BACKGROUND

Sanding tools are used to finish surfaces, such as seams between drywall panels where excess drywall compound has been applied, or in smoothing other surfaces perhaps as a preliminary step to further finishing steps such as applying paints, varnishes or adhesives.

A problem exists, however, when sanding surfaces within a room which contains both wall sections which are easily within reach, as well as surfaces which one cannot easily reach without some sort of assistance. This problem has been previously solved through the use of such items which elevate the user, such as drywall stilts, drywall benches, ladders, and the like. These solutions, because they place the user at an elevated position, place the user at risk of being injured by a fall. In addition, it is cumbersome to lug around this additional equipment and time consuming to set up and change positions using these devices. Other solutions involve the use of separate hand sander devices for the vertical surfaces which are within reach, and then a separate sanding tool having a pole attached for the out-of-reach surfaces, such as ceilings. The problem with this last approach is in having twice the number of tools necessary to finish the surfaces. Not only does the user have to keep track of and carry these extra items to each jobsite, but he or she has to be careful to maintain the same type and grit of sandpaper loaded in each so that the resulting surface finishes match one another.

The applicants' Sander Tool Apparatus, the subject of U.S. Pat. No. 4,885,876, provides for interchangeable top structures of a sanding tool—one with a handle for sanding surfaces within the user's reach, and one with a universal joint and threaded pole coupler, in addition to a threaded pole, for reaching distally located surfaces.

The present disclosure discloses a sander tool which solves many of these problems that are associated with existing sander tools. It will be appreciated that the disclosure may disclose more than one invention. The invention(s) is(are) pointed out with particularity in the claims annexed hereto and forming a part hereof.

BRIEF SUMMARY

The invention(s) generally relate to sander tools suited for sanding planar surfaces.

A preferred embodiment of a sander tool includes an ergonomically shaped handle which is pivotally connected to a housing which includes a unit base and a unit pedestal. The handle pivots about a first pivotal axis through a wide range of angles to accommodate a variety of comfortable arm, wrist, and hand positions for the sanding of surfaces.

In one embodiment, the ergonomic handle includes an upper portion, an intermediate portion, and a lower portion. The upper portion is suitable for gripping by the user; the intermediate portion extends downward at both a first and a second end with an open area between the first and second ends to allow for the placement of the user's hand between the upper portion and the lower portion. The lower portion of the handle contains the first pivotal axis, defined by a pair of handle pivot cones, and is pivotally attached to a pivotal handle mounting surface of the housing.

A preferred embodiment of a sander tool also includes sandpaper retention mechanisms for releasably retaining the sandpaper on the back surface of a unit base.

In one embodiment, the retention mechanism includes a sandpaper retainer pivotally connected to a housing about a third pivotal axis. In addition, latches, integrally molded with the housing member, are provided for releasably latching the sandpaper retention mechanism in a closed position.

One advantage of one embodiment of the sander tool is that it saves the user the inconvenience of suffering strained arm, hand, and finger muscles and ligaments which readily occurs with standard hand sanders.

Another preferred embodiment of a sander tool includes a pivoting pole assembly which additionally allows the user to conveniently sand surfaces which are not within reach by simply attaching a pole to a pivotal pole connector. The pivoting pole is preferably connected to a pivotal pole connector located inside an upper portion of a handle through the use of mating threads, although other suitable fastening methods might be utilized.

One embodiment relates to a kit assembly including a sander tool with a pivotal pole connector and a pole, whereby the sander tool can be readily converted from a hand sander to a pole sander upon releasable attachment of the pole to the pivotal pole connector. Another embodiment relates to a kit assembly including a sander tool with sheets of sandpaper. Yet another embodiment relates to a kit assembly including a sander tool, a pole, and sheets of sandpaper.

The above-mentioned advantages of the various embodiments are only representative and illustrative. The invention(s) is (are) pointed out with particularly in the claims annexed hereto and forming a part hereof.

DETAILED DESCRIPTION

Figure 1:
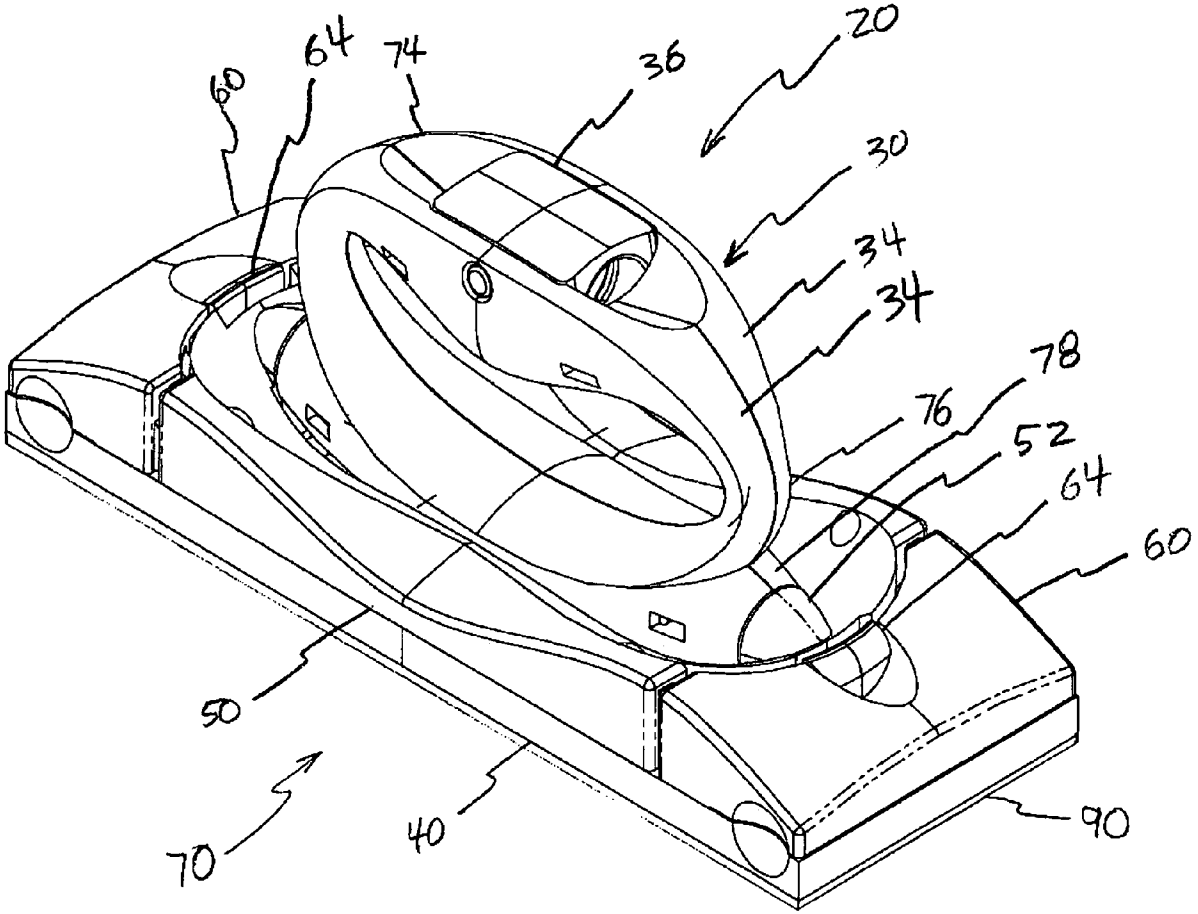
FIG. 1 is a perspective view of a preferred embodiment of a sander tool.
Figure 2:
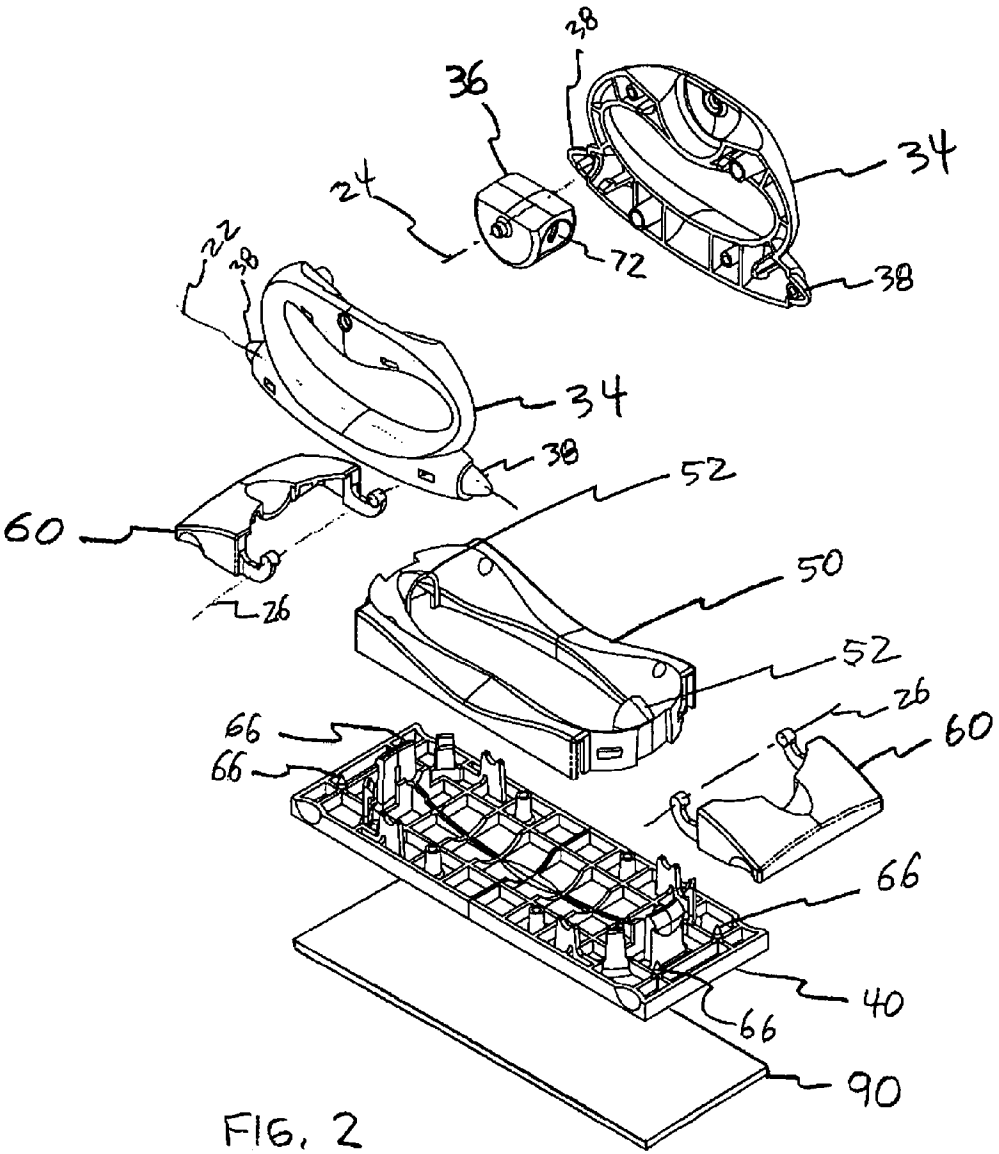
FIG. 2 is an exploded view of the embodiment shown in FIG. 1 with a pivoting handle and a pivoting pole connector.

Referring to the drawings, wherein like reference numerals generally designate identical or corresponding parts throughout the several views, and more particularly to FIGS. 1 and 2, there is shown a preferred embodiment of a sander tool having many components, designated generally by the numeral 20.

The sander tool 20 includes a housing 70 to which a handle 30 is pivotally attached at a first pivotal axis 22 which is located in a longitudinal direction of the sander tool 20. The housing 70 includes a unit base 40, which has a substantially planar bottom side, and a unit pedestal 50 which is attached to the top side of the unit base 40. Preferably, the sander tool is three inches wide and of such a length that a user can cut a standard 9"*11" piece of sandpaper in thirds and has no waste of the sandpaper. The handle 30 pivots about the first pivotal axis 22 through a wide range of angles to accommodate a variety of comfortable arm, wrist, and hand positions for the sanding of surfaces. In addition, the handle includes an upper portion 74, an intermediate portion 76, and a lower portion 78. The upper portion 74 is suitable for gripping by the user, and includes gripping axis 75 (shown orthoganol to the plane of FIG. 4); the intermediate portion 76 extends downward at both a first and a second end with an open area between the first and second ends to allow for the placement of the user's hand between the upper portion 74 and the lower portion 78. The lower portion 78 of the handle 30 contains the first pivotal axis 22, defined by a pair of pivotal cones 38, and is pivotally attached to a pivotal handle mounting surface 52 of the unit pedestal 50 of the housing 70. As shown in FIG. 2, the preferred embodiment of the sander tool 20 is made to be conveniently assembled through the user of resilient snap-fit features on the components, and thus does not require screws, and the like in the assembly of the sander tool 20. Other embodiments, however, may include threaded screws or other fasteners in assembly.

Embodiments optionally include a foam pad 90 attached to the planar bottom side of the unit base 40. The foam pad 90 is made from a foam material such as polyethylene or urethane foams, for example, and is preferably at least 1/16" thick. The foam pad 90 helps accommodate imperfections in the sanding surfaces and may be adhesively mounted to the unit base 40 using common adhesives, or preferably double-sized adhesive tape.

Figure 3:
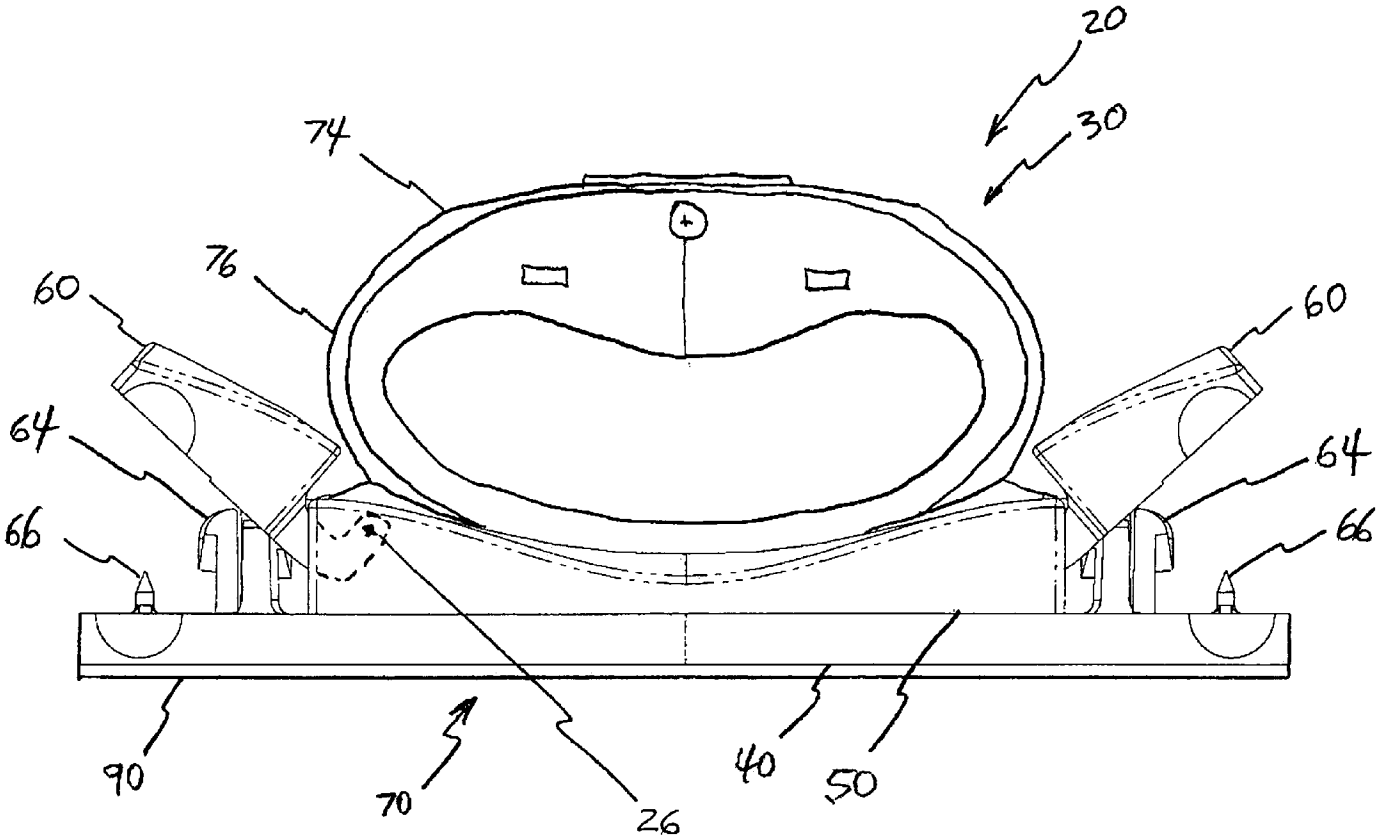
FIG. 3 is a side view of the embodiment shown in FIG. 1 showing both sandpaper retainers pivoted to an open position so that sandpaper may be loaded on to sandpaper retaining spikes.

Sandpaper retention mechanisms are located at each end of the housing 70, as shown in FIG. 3 (without the sandpaper). In the preferred embodiment, a sandpaper retainer 60 is pivotally connected at a third pivotal axis 26 to each end of the housing 70. In addition, a resilient latch 64 is integrally molded with the unit base 40 of the housing 70 for releasably latching the sandpaper retainer 60 in a closed position. The latch 64 is outwardly biased for engagement with the sandpaper retainer 60. Sandpaper retaining spikes 66 are also integrally molded into the unit base 40, and mating sandpaper retainer bosses (not shown), which secure the sandpaper on the sandpaper retaining spikes 66, are integrally molded into the sandpaper retainer 60.

Figure 4:
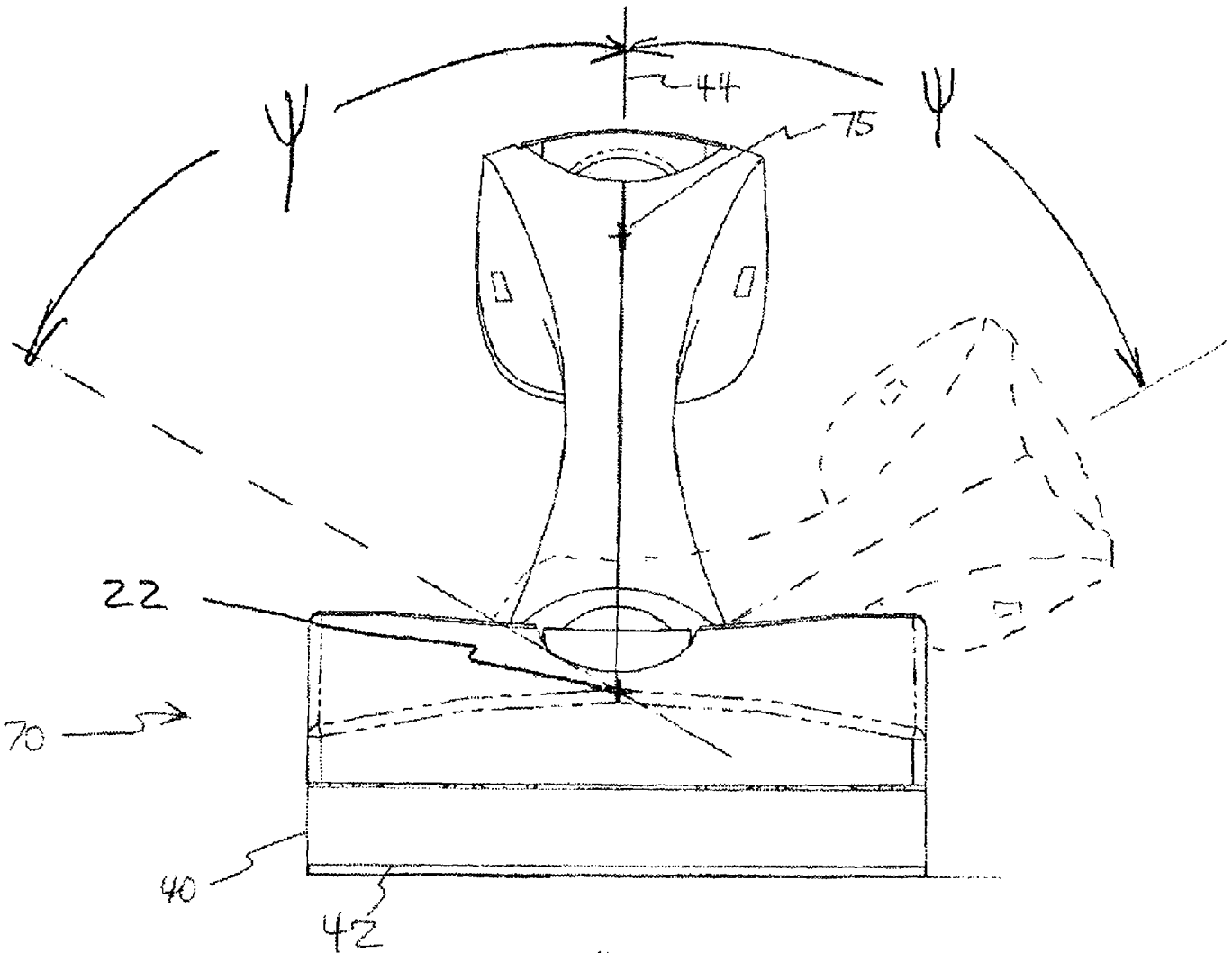
FIG. 4 is a front view of the embodiment shown in FIG. 1 showing the range of motion of the pivoting handle (shown in broken lines).

FIG. 4 shows an angle Ψ, from a first pivotal handle reference plane 44 (shown on edge in FIG. 4) through which the handle 30 may rotate about the first pivotal axis 22 (which has a direction perpendicular to FIG. 4), in either direction. The first pivotal handle reference plane 44 is defined as that plane which contains the first pivotal axis 22 and lies orthogonal to a back surface 42 of housing 70. In the embodiment shown, the handle may rotate through an angle Ψ of about 60° in either direction from the first pivotal handle reference plane 44, although other embodiments may include rotation through an angle Ψ of 90° in either direction from the first pivotal handle reference plane 44. It is preferred that the angle Ψ be through an angle of at least 60° in either direction of the first pivotal handle reference plane 44; more preferably the angle Ψ may be through an angle of at least 30° in either direction from the first pivotal handle reference plane 44; most preferably the angle Ψ may be through an angle of at least 20° from the first pivotal handle reference plane 44.

Figure 5:
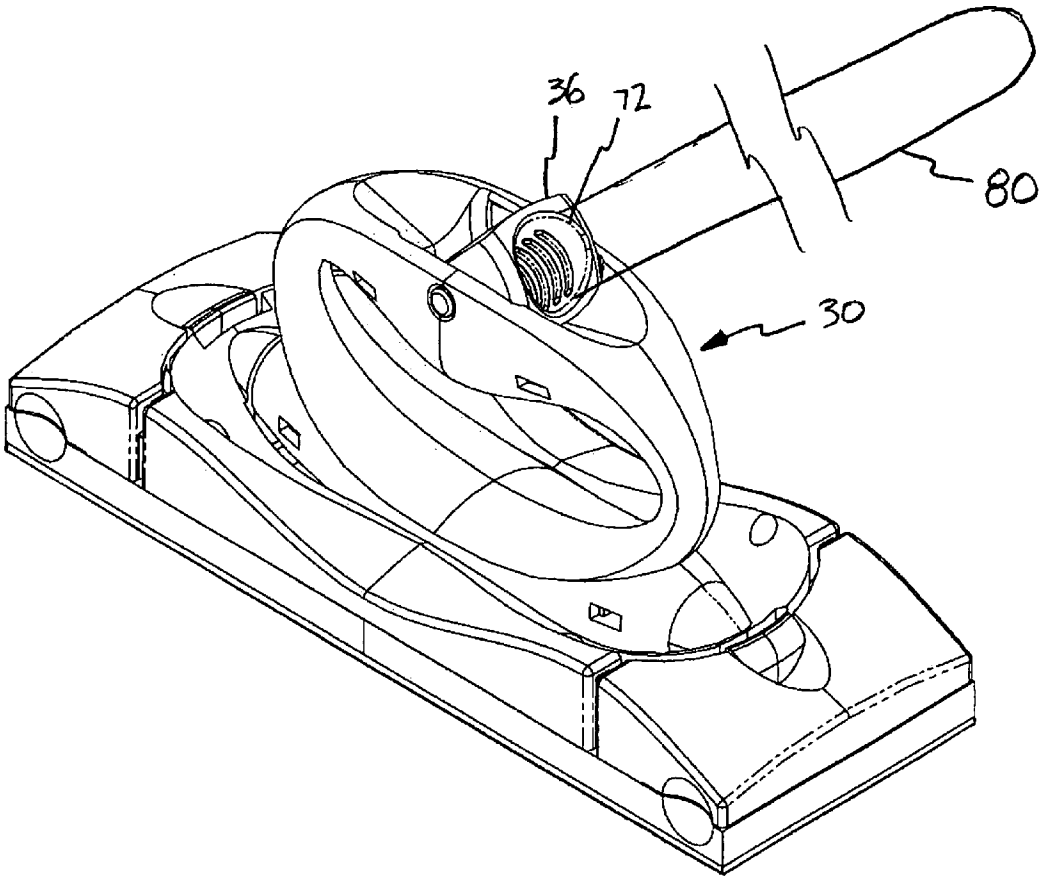
FIG. 5 is a perspective view of the embodiment shown in FIG. 1 of a sander tool showing a pole attached to the pivoting pole connector which allows the user to sand out-of-reach surfaces.

Referring now to FIG. 5, a perspective view of the sander tool with a pole 80 pivotally connected to the handle 30 by a pivotal pole connector 36. The pivotal pole connector 36 is conveniently recessed within the upper portion 74 of the handle 30 so that its 36 outer surface is flush with the handle 30 so that the pivotal pole connector 36 does not interfere with gripping the handle 30 while using the sanding tool 20 on surfaces in close proximity to the user.

In order to sand surfaces located at a distance from the user, the user simply rotates the pivotal pole connector 36 upward slightly, attaches the pole 80, which in the embodiment shown in threaded, to the pivotal pole connector 36, by, for example, threading the pole into an internally threaded cylindrical receptacle 72 located at either end of the pivotal pole connector 36. Other embodiments include a pole 80 connected to a sander tool 20 using quick-release connectors, for example, bayonet-type fittings, snap-fit connectors, and the like.

Figure 6:
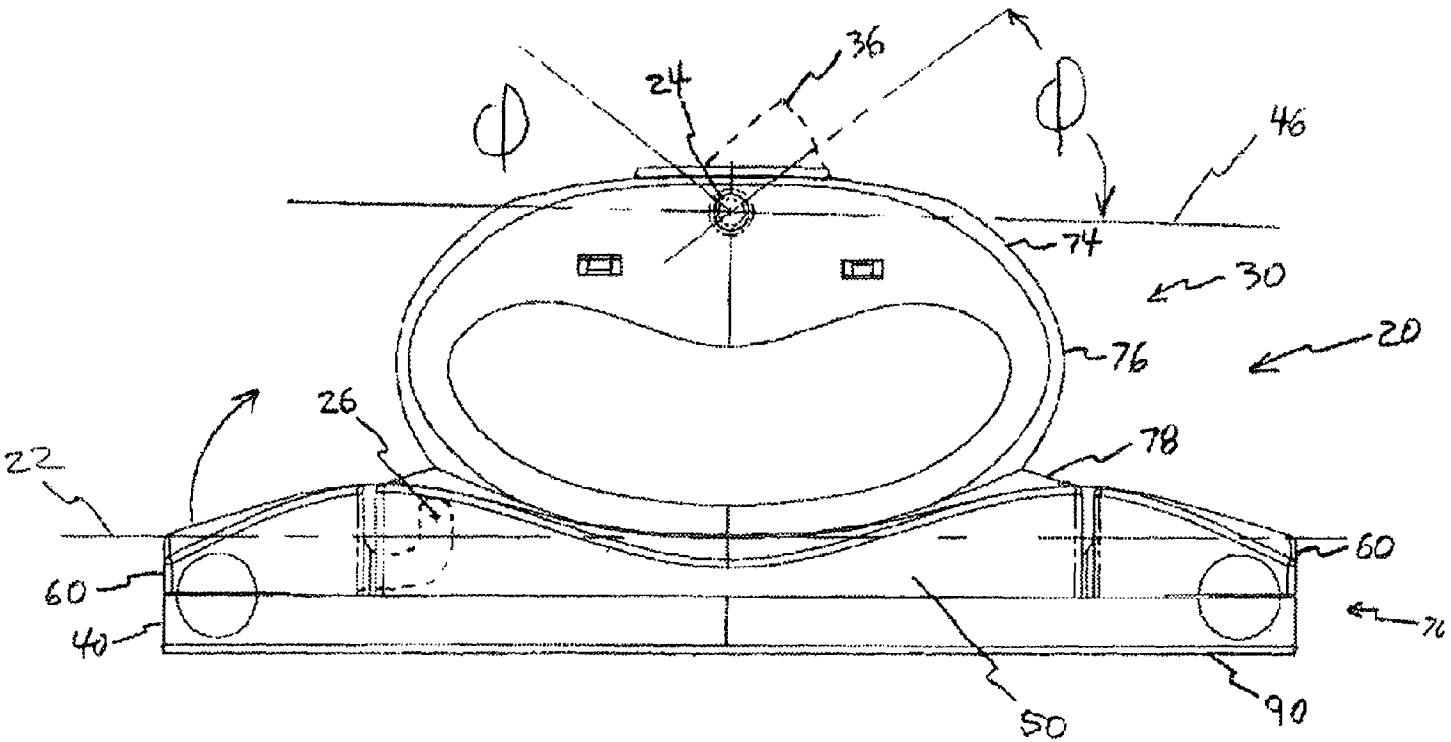
FIG. 6 is a side view of the embodiment shown in FIG. 1 showing the range of motion of the pivoting pole connector (shown in broken lines).
Figure 7:
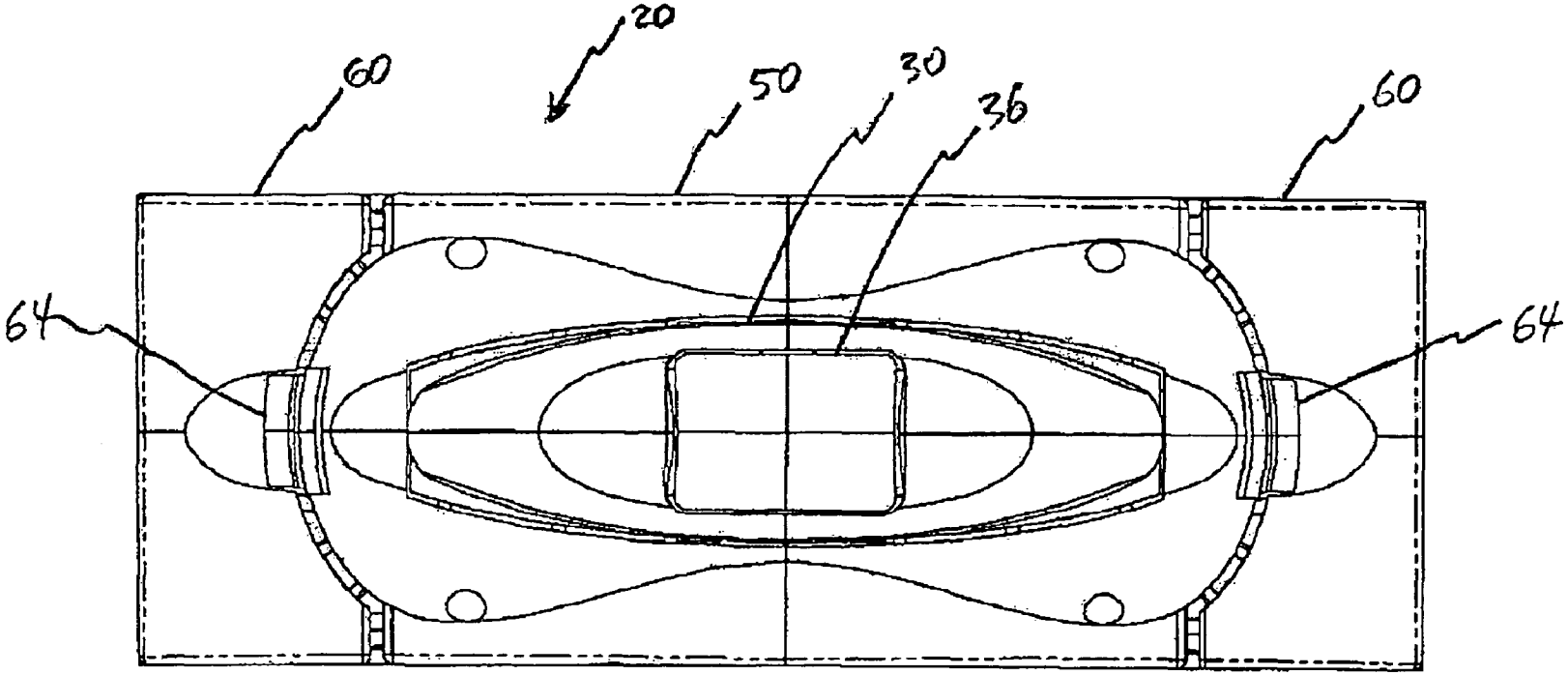
FIG. 7 is a plan view of the embodiment shown in FIG. 1.

FIG. 6 shows an angle Φ from a second pivotal handle reference plane 46 through which the pivotal pole connector 36 may rotate about a second pivotal axis 24 in either direction. The second pivotal handle reference plane 46 lays parallel to the first pivotal axis 22 and contains the second pivotal axis 24. In addition, the second pivotal axis 24 is orthogonal to the first pivotal axis 22. In the embodiment shown, the pivotal pole connector 36 may rotate through an angle Φ of 30° in either direction from the second pivotal handle reference plane 46, although other embodiments may include rotation through an angle Φ of 90° in either direction from the second pivotal handle reference plane 46.

Additionally, a preferred embodiment has a thin wall construction thereby providing a light weight sander. In addition to being light weight, the sander tool includes reinforcement structure such that it is strong and rigid. The components are preferably molded from plastic compounds, although die-casting methods would additionally work using appropriate metal alloys. It will be appreciated that the unit base and unit pedestal structures are designed so that in molding, there is no need for cams, which results in faster molding and a lower mold cost. In addition, the sander tool is preferably held together through the use of snap-fit joints, although other assembly techniques involving such methods as sonic welding and/or the use of fasteners, such as threaded fasteners is contemplated and may be used.

In addition, level of friction between the bearing surfaces, may be tailored through various mechanisms well known to skilled artisans, so that, for example, the components are free standing. This applies to the components of all three pivotal axes 22, 24, and 26 of the pivotal sander 20 in the case where a pole is not attached.

In one embodiment of the present invention, the sander tool 20, and the threaded pole 80 might be sold as a kit assembly, thereby effectively providing two sander tools in one kit. The kit may additionally include sheets of sandpaper.

In use, sandpaper is first secured to the pivotal sander 20. To secure sandpaper, the latch 64 is depressed, the sandpaper retainer 60 is lifted, as shown in FIG. 3, and the end of the sandpaper piece is pushed downward so that sandpaper retaining spikes 66, integrally molded into the unit base 40, pierce through the sandpaper. Then the sandpaper retainer 60 is pushed back into place, the latch re-engages the sandpaper retainer 60, and sandpaper retainer bosses (not shown) located on the underside of the sandpaper retainer 60 hold that end of the sandpaper in place. The same procedure is then repeated at the other end of the pivotal sander, and the unit is operational.

Next, if the user wishes to sand surfaces located within arm's reach, he or she grips the pivotal sander 20 by the upper portion 74 of the handle 30, with fingers freely extending within the intermediate portion 76, positions the bottom side of the unit base 40 on the surface to be sanded, and moves the unit back and forth while applying pressure, preferably along the longitudinal (lengthwise) axis of the unit, until the desired surface finish is achieved. Using various grit sizes of sandpaper may be required for efficiently obtaining the desired result, depending upon the particular circumstances.

Alternately, if the user wishes to sand surfaces located at a distance, he or she threads a threaded pole into the pivotal pole connector 36 of the handle 30 until tight. Next, he or she positions the bottom side of the unit base 40 on the surface to be sanded, and moves the unit back and forth while applying pressure, preferably along the longitudinal (lengthwise) axis of the unit, until the desired surface finish is achieved.

It should be understood that even though these numerous characteristics and advantages of various embodiments have been set forth in the foregoing description, together with details of the structure and function of the embodiments, the disclosure is illustrative only, and changes may be made in detail, especially in matters of shape, size and arrangement of parts within the principals of the invention(s) claimed in the appended claims to the full extent indicated by the broad general meaning of the terms in which the appended claims are expressed.

What is claimed is:

1. A sander tool for use with a sheet of sandpaper, the sander tool comprising:

a housing having a first end and a second end, a substantially planar back surface, a first pivotal handle mounting surface near the first end, a second pivotal handle mounting surface near the second end, said pivotal handle mounting surfaces defining a first pivotal axis, said first pivotal axis laying in a plane parallel to said back surface;

a manual gripping handle pivotally connected to the first pivotal handle mounting surface and the second pivotal handle mounting surface of the housing;

a pivotal pole connector pivotally connected to said handle along a second pivotal axis, so that the second pivotal axis is orthogonal to the first pivot axis; and at least one sandpaper retention mechanism disposed on the housing.

2. The sander tool of claim 1 wherein:

the housing further comprises:

a molded base member having a first end and a second end which correspond to the first and second ends of the housing; and a molded pedestal member connected to the base member, wherein said base member includes the substantially planar back surface of the housing, wherein said back surface faces away from the pedestal member, and the pedestal member includes the pivotal handle mounting surfaces of the housing, wherein said pivotal handle mounting surfaces face away from the base member;

the handle is pivotally connected to the pivotal handle mounting surfaces of the pedestal member; and the sandpaper retention mechanisms are located near the first end of the base member and the second end of the base member.

3. The sander tool of claim 2 further comprising:

integral snap-fit features molded into the unit base, and into the unit pedestal, said snap-fit features connecting the base member to the pedestal member.

4. The sander tool of claim 1 further comprising:

a foam pad attached to the substantially planar back surface of the housing.

5. The sander tool of claim 1 further comprising:

a pole releasably connected to the pivotal pole connector.

6. The sander tool of claim 5, wherein the pole has a set of threads on at least one end, and the pivotal pole connector includes at least one set of mating threads.

7. The sander tool of claim 1 wherein at least one of the sandpaper retention mechanisms comprises:

a sandpaper retainer which is pivotally connected to said housing and pivots about a third pivotal axis; and a latch on said housing for releasably retaining said sandpaper retainer.

8. The sander tool of claim 1 wherein the handle has an upper portion, an intermediate portion, and a lower portion, said upper portion is suited for gripping and has a gripping axis, said intermediate portion extends downward at both a first end and a second end with an open area between the first and the second ends to allow for placement of the fingers of a user's hand between the upper portion and the lower portion, said lower portion is pivotally attached to said pivotal handle mounting surfaces of the housing along the first pivotal axis; and said gripping axis is parallel to said first pivotal axis.

9. The sander tool of claim 8 further comprising:

a first pivotal handle reference plane which is orthogonal to said housing back surface and contains said first pivotal axis;

wherein the handle pivots about said first pivotal axis through an angle of at least 20° in either direction from said first pivotal handle reference plane.

10. The sander tool of claim 9 wherein the handle further comprises:

a pivotal pole connector pivotally connected to said upper portion of said handle along a second pivotal axis, so that the second pivotal axis is orthogonal to the first pivot axis.

11. The sander tool of claim 10 further comprising:

a pole having threads on at least one end which are releasably connected to threads within the pivotal pole connector; and a second pivotal handle reference plane which lays parallel to the first pivotal axis and contains said second pivotal axis, wherein, the pole preferably pivots about the second pivotal axis from 15 degrees to 60 degrees in either direction from the second pivotal handle reference plane.

12. The sander tool of claim 9 wherein at least one of the sandpaper retention mechanisms comprises:

a sandpaper retainer which is pivotally connected to said housing and pivots about a third pivotal axis; and a latch on the housing for releasably retaining said sandpaper retainer.

13. A sander tool kit for use with a sheet of sandpaper, the sander tool kit comprising:

a housing having a first end and a second end, a substantially planar back surface, and a pivotal handle mounting surface facing away from the back surface;

a manual gripping handle having a first pivotal axis pivotally connected to the pivotal handle mounting surface of the housing; and sandpaper retention mechanisms located at the first end of the housing and at the second end of the housing; and a pivotal pole connector pivotally connected to said handle along a second pivotal axis, wherein the second pivotal axis is orthogonal to the first pivot axis.

14. The sander tool kit of claim 13 further comprising:

a pole for connection to said pivotal pole connector.

15. The sander tool kit of claim 13 further comprising:

sheets of sandpaper.

* * * * *